United States Patent [19]

Frear

[11] Patent Number: 4,478,473

[45] Date of Patent: Oct. 23, 1984

[54] COUPLING NUT FOR AN ELECTRICAL CONNECTOR

[75] Inventor: David L. Frear, Afton, N.Y.

[73] Assignee: Bendix Corporation, Southfield, Mich.

[21] Appl. No.: 431,969

[22] Filed: Sep. 30, 1982

[51] Int. Cl.[3] ..... H01R 13/623

[52] U.S. Cl. ..... 339/89 M; 339/DIG. 2

[58] Field of Search ..... 339/DIG. 2, 89 R, 89 C, 339/89 M, 90 R, 90 C; 285/82, 84, 86, 87, 92; 411/296, 299, 300

[56] References Cited

U.S. PATENT DOCUMENTS 3,170,337 2/1965 Linley, Jr. ..... 411/296

3,343,852 9/1967 Blight et al. ..... 339/89 M 3,470,524 9/1969 Culver ..... 339/90 R 3,601,764 8/1971 Cameron ..... 339/89 M

*Primary Examiner*—John McQuade

*Attorney, Agent, or Firm*—C. D. Lacina

[57] ABSTRACT

A coupling nut (300) comprises outer and inner coupling sleeves (320, 330) mounted for rotation about a connector shell (100) having a plurality of ratchet teeth (150) formed on the outer periphery of an annular shoulder thereof, a plurality of equiangularly disposed, radially biased, lock pins (350) being carried by inner coupling sleeve (330) during coupling and being adapted to be cammed radially inwardly by outer coupling sleeve (320) into a locked relation with the ratchet teeth.

9 Claims, 7 Drawing Figures

FIG. 2
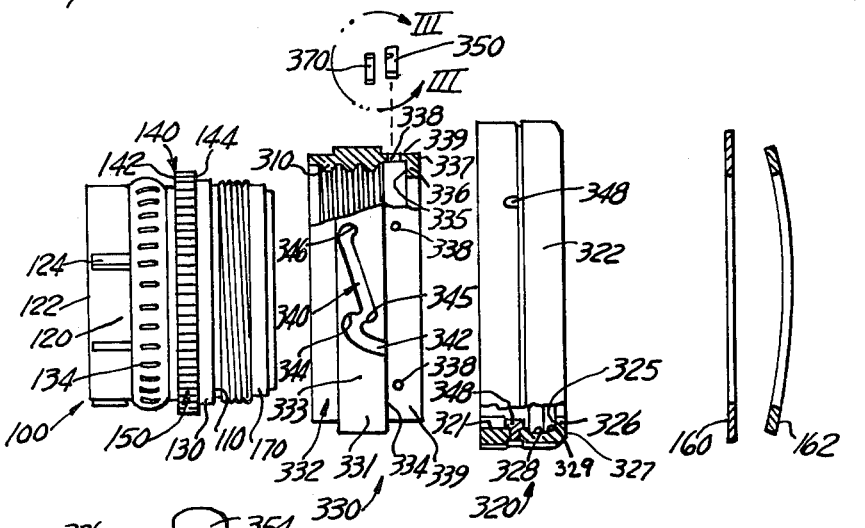
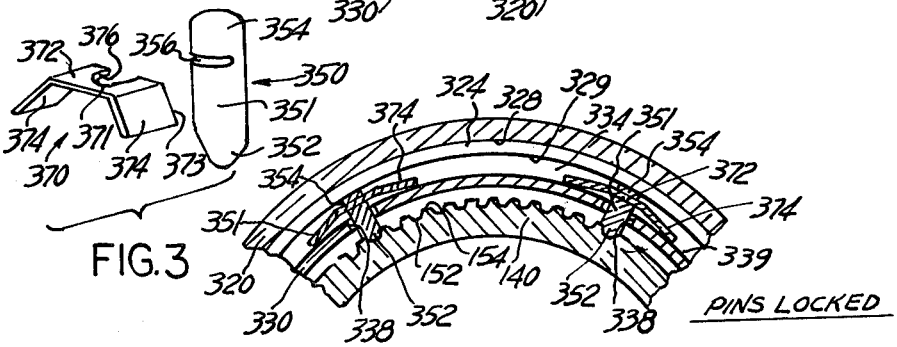
FIG. 3
FIG. 7
FIG. 5
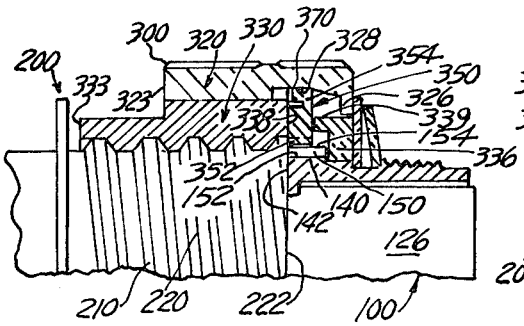
FIG. 6
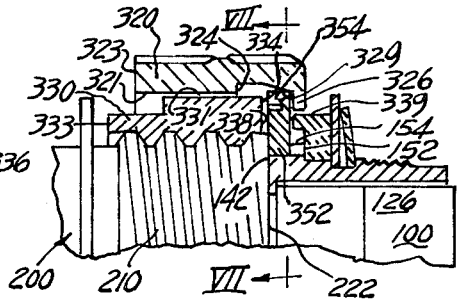

COUPLING NUT FOR AN ELECTRICAL CONNECTOR

This invention relates to a coupling nut for an electrical connector and more particularly to a compound coupling nut providing a positive lock between the coupling nut and connector at full-mate.

An electrical connector assembly is generally comprised of two generally cylinderical connector shells, each shell retaining therein electrical contacts with the electrical contacts of one shell being matable with the electrical contacts in the other shell when the connector shells are connected together by a coupling member. The coupling member is generally rotatably mounted to one of the connector shells by a retaining ring captivating a flange of the coupling member adjacent a shoulder of the one connector.

During mating and unmating, electrical connectors must be easily and quickly coupled and decoupled with use of reasonable forces. Once mated and in use, however, the electrical connector assembly must remain connected despite vibrational and/or other forces which might be applied to the connector assembly and which might uncouple the connectors. Various anti-rotation devices to prevent unwanted back-off and/or disconnection are known.

In "Electrical Connector Assembly having an Anti-Decoupling Mechanism" U.S. Pat. No. 4,109,990 issuing Aug. 29, 1972 Waldron et al, a straight spring beam has its ends mounted to the coupling nut and constantly biases a medial tooth thereof into co-acting engagement with ratchet teeth disposed around an annular shoulder extending from the connector shell. However, some vibration environments may cause the straight spring beam with its tooth to allow back-off between teeth of perhaps one or two ratchet clicks and the connector shells to undergo axial back-off from metal-to-metal contact resulting in hammering between connector shells. After 500 or more cycles of constant rotational engagement between the medial tooth and the ratchet teeth, the teeth will wear down and the force to resist uncoupling reduced. Due to this reduction in uncoupling force, the coupling nut will back-off more easily during vibration exposure.

This invention provides an anti-decoupling device which promotes locking of the coupling nut relative to its associated plug shell after a connectable receptacle shell has achieved full mate (metal-to-metal contact) with the plug shell. More specifically, the anti-decoupling device comprises the coupling nut mounted to the plug shell for rotation thereabout and comprising coaxially, rotatably, disposed inner and outer coupling sleeves including a plurality of generally equiangularly spaced, radially biased, lock pins mounted in the inner coupling sleeve, each lock pin being protectively mounted for radial movement within like support openings disposed around the inner sleeve and circumposed about a contiguous succession of ratchet teeth on the plug shell, the coupling sleeves including a locking arrangement which allows the coupling sleeve's to be driven as a unit during coupling in one rotational direction and locks the coupling sleeves after full-mate is achieved by further coupling direction rotation of the outer coupling sleeve independent of the inner coupling sleeve, the locking resulting from the lock pins being driven into engagement with the ratchet teeth.

An advantage of the coupling nut according to this invention is provision of a self-contained anti-decoupling device which is less prone to vibration and prevents back off from full-mate between connector shells. Another advantage of this invention is an anti-decoupling device which reduces material wear during coupling/uncoupling by actuating looking between connector shells only when at full mate.

One way of carrying out the invention is described below with reference to the drawings which illustrate one specific embodiment of this invention, in which:

FIG. 2 is an exploded view, partially in section, of the coupling nut according to the present invention removed from one electrical connector of the assembly.

FIG. 3 is an exploded view of a lock pin taken along lines III—III of FIG. 2.

FIG. 5 is a partial side view in section showing full-mate between the electrical connector assembly.

FIG. 6 is a partial side view in section showing the connector assembly at full mate in a locked condition.

FIG. 7 is an end view taken along lines VII—VII of FIG. 6.

Figure 1:
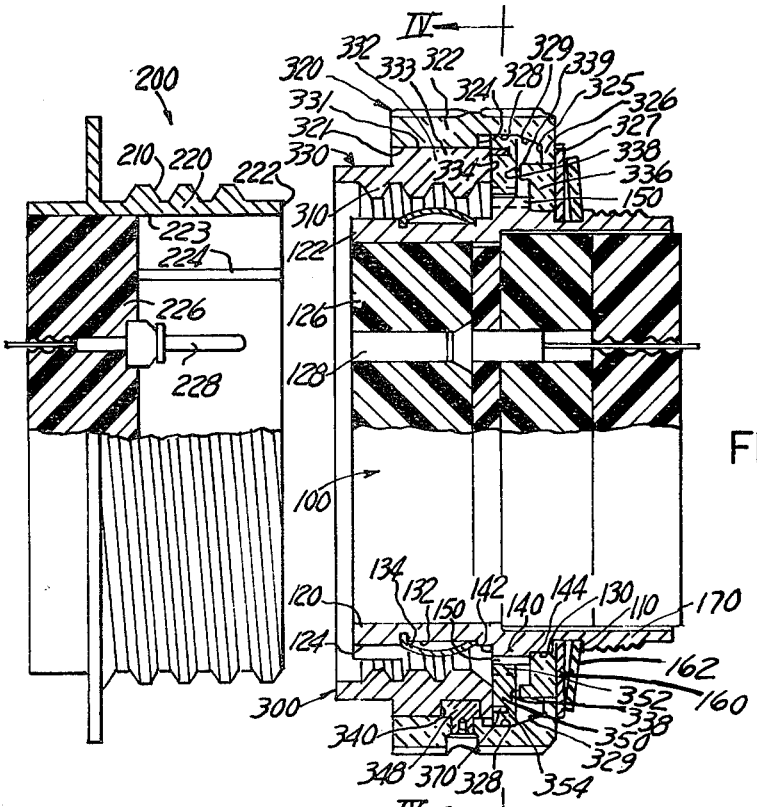
FIG. 1 is a side view, partially in section, of an electrical connector assembly including a coupling nut.

Referring now to the drawings and FIG. 1 in particular, an electrical connector assembly according to the present invention includes coaxial first and second shells 100, 200 positioned for mating engagement and a coupling nut 300 mounted for rotation to first shell 100 for connecting the first shell and second shell in mating relationship.

The first shell 100, also considered a plug-type connector, includes a cylindrical front portion 120 having a front face 122, a rear portion 170 and an annular shoulder 140 medially of the shell portions, the rear portion 170 including a stepped groove 110 and an annular wall 130 circumjacent the annular shoulder. The annular shoulder 140 includes a front face 142, a rear face 144 and a plurality of rachet teeth 150 on its outer circumferential surface. The first shell also includes one or more female-type (i.e. socket) electrical contacts 128 retained therewithin by one or more dielectric inserts 126. The outer surface of front portion 120 includes one or more axial keys 124 for orienting first shell 100 relative to second shell 200. An annular recess 132 forwardly of annular shoulder 140 is adapted to receive a shield spring 134 for grounding the connector shells 100, 200 from radio frequency interference.

The second shell 200, also considered a receptacle-type connector, includes a front portion 220 having a front face 222, and inner wall 223 and external thread 210 on the outside surface thereof. Further, shell 200 includes one or more axially extending recess or keyways 224 for receiving the respective keys 124 on first shell 100, one or more dielectric inserts 226 mounted therewithin and one or more male-type (i.e. pin) electrical contacts 228 adapted to mate with the socket-type contacts 128 of first shell 100, the pin contacts 228 being retained within the dielectric inserts 226. Of course, the pin-socket contacts 128, 228 could be other than shown.

The coupling nut 300 is rotatably mounted on first shell 100 and includes internal threads 310 adapted to mate with the external threads 210 on second shell 200 to draw the first and second shells 100, 200 together with contacts 128, 228 mated. As shown, an inwardly extending radial flange 336 on coupling nut 300 is adapted to be received about annular wall 130 and captivated for rotation against rear face 144 of annular shoulder 140, radial flange 336 being retained against annular shoulder 140 and the coupling nut being retained on the shell by a retaining ring 160 received within stepped groove 110.

Preferably and in accord with this invention, coupling nut 300 is a compound coupling member which comprises generally cylindrical first and second coaxial coupling sleeves 320, 330 mounted for rotation relative to one another with the second and inner sleeve 330 including radial flange 336 and carrying a plurality of radially movable, lock pins 350 biased by a spring member 370 from engagement with ratchet teeth 150 but adapted to be driven into engagement therewith for locking.

Inner coupling sleeve 330 is one-piece and comprises a tubular shell 332 including a rearward end portion having an exterior or first outer surface 339 and a medial shoulder 333 extending radially outward therefrom and defining an exterior or second outer surface 331 and a transverse end face 334 circumjacent outer surface 339, the radial flange 336 extending radially inward from the rearward end portion, the thread 310 being on the inner wall of tubular shell 332 and outer surfaces 339, 331 being concentric with one another relative to the primary axis of the coupling nut. A plurality of openings 338 are disposed equiangularly about tubular shell 332, each opening extending radially through outer surface 339 and sized to receive one of the lock pins 350.

Outer coupling sleeve 320 is one piece and comprises a tubular shell 322 having an interior wall 321 and including a radial flange 326 extending radially inward from a rearward end portion thereof, radial flange 326 defining, respectively, inner and outer end walls 325, 327. An annular undercut 328 and an annular cam 329 extend around the interior wall 321 circumjacent inner end wall 325 of radial flange 326, the undercut and cam being contiguous to define an annular cavity for receiving lock pin 350 and annular undercut 328 defining a transverse end wall 324 allowing rearward axial movement of outer coupling sleeve 320 relative to inner coupling sleeve 330.

Retaining ring 160 is disposed against radial flanges 326, 336.

To allow sliding movement between coupling sleeves 320, 330, a frusto-conical annular spring 162 is received in stepped groove 110 and has its rim biasing against retaining ring 160.

Two lock pins 350 are shown disposed in their respective openings 338 through inner coupling sleeve 330. Each lock pin 350, although shown best in FIG. 3, includes a generally cylindrical body 351 having a domed end 354 for engaging undercut 328 and cam 329 and a pointed end 352 for engaging the ratchet teeth 150. Cooperatively attached to each lock pin 350, shown best in FIG. 3, is spring member 370, the spring member being adapted to constantly and consistently bias its respective lock pin radially outwardly of its opening 338. Transverse end face 334 is adapted to position the spring thereagainst. As shown, domed end 354 is biased outwardly and into abutment with annular undercut 328 and pointed end 352 outwardly from engagement with the ratchet teeth. This represents an unlocked position of coupling nut 300 relative to shells 100, 200.

Preferably and in accord with this invention a bayonet-type lock arrangement for simultaneously locking each of the lock pins 350 into their engaged relation with respective of the ratchet teeth 150 comprises a bayonet slot 340 disposed in medial shoulder 333 of inner coupling sleeve 330 being adapted to receive a bayonet pin 348 extending radially inwardly from outer coupling sleeve 320.

FIG. 2 shows disassembly of coupling nut 300 from plug shell 100. Inner coupling sleeve 330 includes flange 336 having inner and outer end walls 335, 337, respectively, with inner end wall 335 thereof being adapted to be abutted against rear face 144 of annular shoulder 140 to position the inner coupling sleeve relative to the plug shell.

Bayonet slot 340 is disposed within outer surface 331 of medial shoulder 333 of coupling sleeve 330, the slot extending from transverse end face 334 and including a humped entryway 342 at one end and an arcuate detent 346 at the other end, entryway 242 having transverse forward and rearward shoulders 344, 345 which define abutment faces for captivating the bayonet pin. For effecting coupling/uncoupling rotation, bayonet pin 348 is seated, respectively, against forward and rearward shoulders 344, 345 and rotation of outer coupling sleeve 320 constrains inner coupling sleeve 330 to rotate therewith. Upon coupled engagement, bayonet pin 348 is advanced in slot 340 to detent 346, whereby pins 350 are driven inwardly into ratchet teeth 150 and further rotation prevented. Annular spring 162 allows rearward movement of bayonet pin 348 and forward bias to capture the bayonet pin 348 in detent 346. According to this invention, if coupling nut thread 310 is right-handed, then bayonet slot 340 is right-handed and vice-versa. Preferably three bayonet slots 340 and corresponding bayonet pins 348 would be provided equiangularly about their respective sleeves.

Locking pin 350 and spring 370 are shown aligned for mounting within opening 338 on inner coupling 330.

FIG. 3 is a detail view of a locking pin 350 disassembled from spring 370. Lock pin 350 includes a generally cylindrical body 351 having domed end 354 and pointed end 352, body 351 further including including a transverse annular slot 356 extending therein medially of its ends. Spring member 370 includes a flat plate 372 having a pair of skirts 374 extending therefrom, flat plate 372 having extend from one edge 373 thereof a U-shaped slot 376 sized to fit within annular slot 356 of the pin and the other edge 371 of the skirts and plate being adapted to abut the transverse end face 334 to secure spring member 370 and lock pin 350 together.

Figure 4:
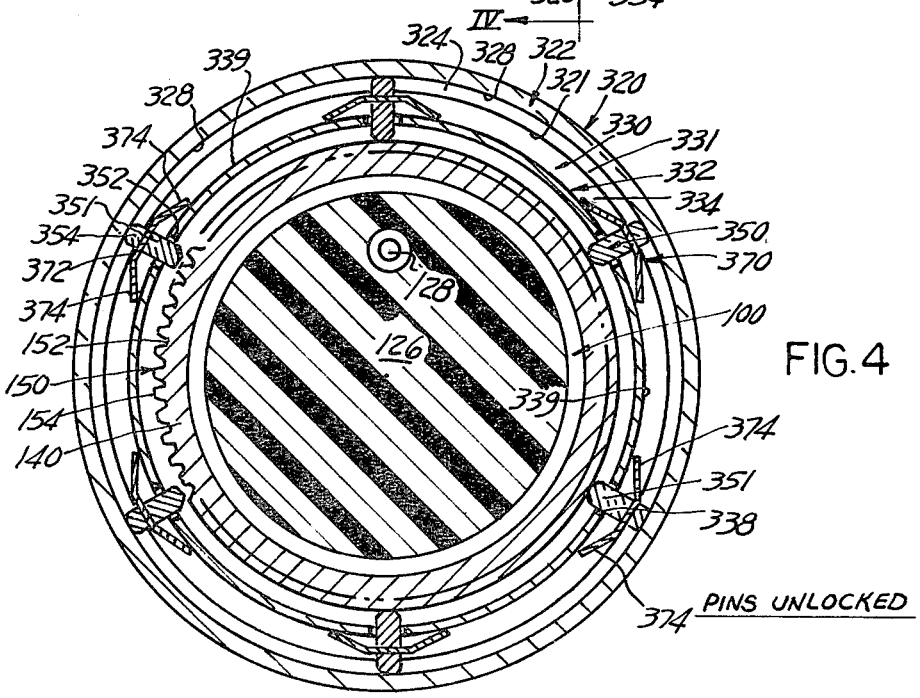
FIG. 4 is an end view taken along line IV—IV of FIG. 1.

FIG. 4 is an end view through the plug shell 100 showing detail of coupling nut 300 in the unlocked position. Six lock pins 350 are equiangularly disposed around the plug shell, each pin having its domed end 354 biased by skirts 374 into abutment against annular undercut 328 and pointed end 352 out of engagement with the ratchet teeth 150 disposed on annular shoulder 140, the ratchet teeth forming, respectively, a contiguous succession of peaks and valleys 154, 152, with valleys 152 being sized to receive pointed ends 352 of lock pin 350 for providing the locked position.

FIG. 5 shows a full mate condition wherein end face 222 of receptacle shell 200 has been drawn within coupling nut 300 and into abutment (i.e. metal-to-metal contact) with forward face 142 of annular shoulder 140 around plug shell 100. Each of the lock pins 350 are in their unlocked position and biased radially outwardly in openings 338 from engagement with ratchet teeth 150.

FIG. 6 shows the full-mate condition wherein lock pins 350 are in locked engagement in respective valleys 152 of ratchet teeth 150. Outer coupling sleeve 320 has been rotated in the coupling direction and advanced longitudinally forward relative to inner coupling sleeve 330, resulting in bayonet pin 348 being advanced through its slot 340 and into detent 346. As a result of outer sleeve 320 being rotated forward relative to inner coupling sleeve 330, annular undercut 328 and cam 329 advance forwardly with the cam 329 driving the lock pins 350 downwardly (i.e. radially inward) and into engagement with ratchet teeth 150.

FIG. 7 shows an end view of the locked full-mate condition. Skirts 374 have been flattened against outer surface 339 of inner coupling sleeve 330 and pointed ends 352 of lock pins 350 driven into their respective valleys 152 of ratchet teeth 150.

Coupling nut 300 would be assembled by sliding inner coupling sleeve 330 over rear portion 170 of plug shell 100 and abutting its radial flange 337 against rear face 144 of annular shoulder 140; assembling spring member 370 with lock pins 350 by inserting the U-shaped slot 376 of spring member 370 into the annular slot 356 of lock pin 350; radially inserting cylindrical bodies 351 of each lock pin 350 into openings 338 of inner coupling sleeve 330; sliding outer coupling sleeve 320 over inner coupling sleeve 330, the domed ends 354 positioning themselves within the annular cavity and against annular undercut 328; advancing bayonet pin 348 into entryway 342 against abutment shoulders 344, 345; sliding retaining ring 160 over rear portion 170 of the plug shell and into abutment with radial flanges 326, 336; and captivating the assembly with annular spring 162 being received in stepped groove 110.

To complete an electrical connector assembly, the shells 100, 200 would be positioned so that keys and keyways 124, 224 are aligned and then axially advanced towards each other until the thread 210 on the receptacle shell 200 is engaged by the thread 310 on the inner coupling sleeve 330. Rotation of coupling nut 300, shown best in FIGS. 5 and 6, axially advances front portion 120 of the first shell inwardly into front portion 220 of the second shell, inner wall 223 of the second shell 200 compressing shield 134 into annular recess 136 with continued advance of the shell front portions 120, 220 advancing front face 222 into abutment against front face 142 of annular shoulder 140 when the full mate condition is achieved.

Bayonet pin 348 functions first to drive the coupling sleeves 320, 330 together as a unit during coupling/uncoupling direction rotation and second to actuate locking relation between the sleeves and first connector shell 100. Forward axial motion results from bayonet pin 348 being driven against forward shoulder 344 within humped entryway 342. As a result of this rotation, the shells 100, 200 do not corotate relative to one another but are axially drawn towards one another until end face 222 of the receptacle shell 200 is in metal-to-metal contact with the plug shell 100. Longitudinal rearward sliding motion of bayonet pin 348 over the hump of sufficient magnitude to overcome the forward bias of annular spring 162 drives the outer sleeve 320 slightly rearwardly relative to inner sleeve 330 which allows the bayonet pin to be driven longitudinally forward in slot 340. Forward advance of outer sleeve 320 advances annular cam 329 forwardly and into contact with lock pins 350, this contact driving the lock pins radially inward and into engagement with ratchet teeth 150. Bayonet pin 348 is advanced through through slot 340 and into register with arcuate detent 346 where upon annular spring 162 drives the outer coupling sleeve 320 forwardly relative to inner coupling sleeve 330 whereby the bayonet pin 348 is captured in the detent. Contact between forward faces of dielectric inserts 126, 226 provides a slight rearward bias against the shells 100, 200, providing resistance which the bayonet pin must overcome to move forwardly and from its detent.

Although the description of this invention has been given with reference to a particular embodiment, it is not to be construed in any limiting sense, many variations and modifications possibly occurring to those skilled in the art. For example, the bayonet slot 340 could require left-handed advance of bayonet pin 348 relative to right-handed coupling advance of the inner coupling sleeve 330.

I claim:

1. A coupling nut for an electrical connector of the type having first and second shells (100, 200) connectable in end-to-end relation, one of said shells (100) including a plurality of ratchet teeth (150) arranged annularly and extending radially outward therefrom, the coupling nut including a cylindrical sleeve (330) captivated for rotation about said first shell (100) and provided with internal thread (310) for threadably connecting with complementary external thread (210) disposed on said second shell (200), rotation of the coupling nut drawing the shells (100, 200) together, said coupling nut characterized by:

said cylindrical sleeve (330) being provided with an opening (338), said opening being in register with and about said ratchet teeth (150);

a lock pin (350) having its cross-section clearance fit within said opening and constrained for only radial movement in said opening (338);

bias means (370) having a portion thereof disposed against said sleeve for constantly biasing said lock pin radially outward from engagement with said ratchet teeth; and drive means (320, 329) disposed for both rotational and axial movement relative to the cylindrical sleeve for driving the cylindrical sleeve in coupling and uncoupling directions and driving the lock pin radially inward and into engagement with the ratchet teeth.

2. The coupling nut as recited in claim 1, characterized by locking means (348, 346, 162, 340) for locking said lock pin (350) within respective ones of said ratchet teeth, said lock pin (350) being generally cylindrical and having a medial portion (351) disposed for reciprocation in said opening (338) and an end portion (352) disposed radially within said sleeve (330) and adapted to engage said ratchet teeth (150).

3. The coupling nut as recited in claim 2 wherein said cylindrical sleeve (330) includes an annular undercut (328) and said bias means (370) comprises a spring band (370) operatively associated therewith and with the outer surface of said cylindrical sleeve (330), said annular undercut (328) being disposed on the inner surface of said sleeve and circumposing said ratchet teeth.

4. The coupling nut as recited in claim 2, said drive means (320, 329) being characterized by a second sleeve (320) coaxially disposed and relatively rotatable about the first cylindrical sleeve (330), and said lock pin (350)

having a generally dome-shaped head (352) disposed radially outward from the cylindrical sleeve (330) and adapted to be normally biased against said second sleeve (320) and a generally V-shaped tail (352) adapted to be driven radially inward towards the one shell (100) and fit within ones of said ratchet teeth.

5. The coupling nut as recited in claim 4, wherein said locking means (348, 346, 162, 340) comprises an elongated slot (340) disposed on one of said sleeves (330) being sized to receive and captivate a bayonet-type pin (348) disposed on the other of said sleeves (320).

6. The coupling nut as recited in claim 2, wherein six lock pins (350) are disposed generally equilangularly around said sleeve (330) in a clearance fit within like openings (338).

7. The coupling nut as recited in claim 5, characterized in that said slot (340) advances said bayonet-type pin (348) in a rotational directional contrary to the advance of said first thread (310).

8. An electrical connector of the type comprising a cylindrical shell (100) including an annular shoulder (140) having ratchet teeth (150) disposed on its periphery; a first coupling sleeve (330) rotatably mounted to said shell (100), said first coupling sleeve (330) having a tubular forward portion (332) adapted to mate with a compatible shell; and means for preventing rotational movement of the coupling sleeve (330) relative to shell (100), said means for preventing rotational movement of the coupling sleeve being characterized by:

said first coupling sleeve (330) including an opening (338) passing radially through the sleeve to register with said ratchet teeth;

a second coupling sleeve (320) disposed about the first coupling sleeve (330), the second coupling sleeve including an annular undercut (328) disposed around said opening (338);

a lock pin (350) disposed in said opening (338);

a band (370) comprised of resilient metal biasing against said first coupling sleeve (330) and connected to said lock pin (350) for normally biasing the lock pin radially outwardly against the second coupling sleeve (320); and means (328) for driving the lock pin radially inward and into engagement with said ratchet teeth.

9. An anti-decoupling mechanism for an electrical connector assembly of the type having a pair of cylindrical mating shells (100, 200) and a coupling nut (300), one of said shells (100) including a plurality of ratchet teeth (150) arranged annularly and extending radially outwardly around said shell, the other of said shells (200) having a thread (210) on the outside surface thereof, said coupling nut being rotatably mounted about said one shell (100) and including a cylindrical coupling sleeve (330) provided with an internal thread (310) adapted to engage the thread (210) disposed on the other of said shells (200) so that when said threads (210, 310) are engaged rotation of the coupling nut in one direction draws the shells (100, 200) together, said anti-decoupling mechanism characterized by:

lock means (350, 370, 340) for locking the coupling sleeve (330) from rotation relative to said one shell (100), said lock means including a lock pin (350) adapted to move radially between first and second positions, respectively, wherein the lock pin is disengaged and engaged with said ratchet teeth (150);

bias means (370) coupled to the lock pin for normally biasing the lock pin into the disengaged position; and drive means circumposed about said coupling sleeve for driving the pin between said positions of engagement, said drive means comprising an operating sleeve (320) including an annular cavity defining an actuating cam (329), said bias means (370) being disposed intermediate said operating sleeve and coupling sleeve.

* * * * *